US005448777A

United States Patent [19]

Lew

[11] Patent Number: 5,448,777

[45] Date of Patent: Sep. 12, 1995

[54] THERAPEUTIC GLOVE

[76] Inventor: Chae W. Lew, 2425 Sky Farm Dr., Hillsboro, Calif. 94010

[21] Appl. No.: 163,150

[22] Filed: Dec. 6, 1993

[51] Int. Cl.[6] ..... A41D 19/00

[52] U.S. Cl. ..... 2/161.7; 2/159; 2/163; 606/204

[58] Field of Search ..... 2/159, 160, 161.1, 161.6, 2/161.7, 163, 20, 21; 606/201, 204; 128/907, 880; 601/133, 134, 135, 138, 136, 137, 40; 602/22

[56] References Cited

U.S. PATENT DOCUMENTS

| | | | |
|---|---|---|---|
| 3,595,225 | 7/1971 | Beeman | 606/204 |
| 3,866,597 | 2/1975 | Boxer | 606/204 |
| 3,916,448 | 11/1975 | Hammel | 2/161 R |
| 4,122,852 | 10/1978 | Knetsch et al. | 606/204 |
| 4,272,849 | 6/1981 | Thurston | 2/16 |
| 4,694,508 | 9/1987 | Iriyama et al. | 2/161.6 |
| 4,716,898 | 1/1988 | Chauve et al. | 606/204 |
| 4,723,324 | 2/1988 | Lassiter | 2/161.6 |
| 4,813,079 | 3/1989 | Reitzel | 2/160 |
| 4,858,245 | 8/1989 | Sullivan et al. | 2/163 |
| 4,864,661 | 9/1989 | Gimbel | 2/167 |
| 4,911,433 | 3/1990 | Walker et al. | 272/119 |
| 4,947,487 | 8/1990 | Saffer et al. | 2/167 |
| 4,995,119 | 2/1991 | Codkind | 2/161.6 |
| 5,093,933 | 3/1992 | Berry | 2/163 |
| 5,199,876 | 4/1993 | Waldman | 2/159 |
| 5,250,067 | 10/1993 | Gelfer et al. | 606/204 |

FOREIGN PATENT DOCUMENTS

| | | | |
|---|---|---|---|
| 2200198 | 7/1972 | Germany | 2/161.6 |
| 2914692 | 10/1980 | Germany | 2/161.6 |
| 3641606 | 1/1988 | Germany | 2/159 |
| 3819859 | 12/1989 | Germany | 606/204 |
| 4269973 | 9/1992 | Japan | 606/204 |

*Primary Examiner*—Clifford D. Crowder
*Assistant Examiner*—Amy B. Vanatta
*Attorney, Agent, or Firm*—Donald E. Schreiber

[57] ABSTRACT

This invention generally concerns therapeutic appliances for alleviating pain by applying a moderate amount of pressure to specific locations on an individual's hand. The present invention includes a glove having a supple, fitted covering that envelopes at least a portion of a human hand. The glove's covering has an inner surface that is juxtaposed with and contacts the skin of the hand, and to which one or more pressure pads are secured. The appliance's covering urges each pressure pad into intimate contact with the skin of the hand at specific locations thereon for applying a moderate amount of pressure thereto.

18 Claims, 1 Drawing Sheet

THERAPEUTIC GLOVE

BACKGROUND OF THE INVENTION

1. Field of the Invention

The present invention relates generally to therapeutic appliances, and more particularly, to a glove like appliance adapted for exerting pressure to the skin of a wearer's hand for alleviating ailments.

2. Description of the Prior Art

Modern life is stressful. Undue stress can adversely affect an individual's recreational activities including their performance in sports. Stress can diminish an individual's sense of concentration, their sensitivity, their physical agility, their balance, etc. Symptoms of stress can include muscle tension, anxiety, cramps, persistent fatigue, headache, backache, etc. Therapies for relieving such ailments include acupuncture, a traditional therapeutic technique in which fine needles are inserted into an individual's body. More recently, Korean hand acupuncture theory has discovered that merely applying pressure to the skin at specific locations can relieve physical symptoms, including symptoms of stress such as those which adversely affect an individual's sport's performance.

U.S. Pat. No. 3,916,448 which issued on Nov. 4, 1975, on an application filed in the name of John S. Hamel ("the Hamel Patent") discloses a protective glove for law enforcement officers which includes an outer layer of lead-filled vinyl and two intermediate layers of wire mesh which are sandwiched between, among other things, an inner lining and an outer glove side.

U.S. Pat. No. 4,272,849 which issued on Jun. 16, 1981, on an application filed in the name of Jay D. Thurston ("the Thurston Patent") discloses a glove for workmen which includes stainless steel plates located on the back of the hand that are sandwiched between an inner liner and an outer layer of the glove to protect the workman's hand against being crushed.

U.S. Pat. No. 4,813,079 which issued on Mar. 21, 1989, on an application filed in the name of Jimmie R. Reitzel ("the Reitzel Patent") discloses a weighted sports glove in which lead wool is sandwiched between an inner panel and an outer panel.

U.S. Pat. No. 4,864,661 which issued Sep. 12, 1989, on an application filed in the name of Neal I. Gimbel ("the Gimbel Patent") discloses a puncture resistant surgical glove which employs stalls at particular locations on the fingers and thumb of a health care provider's hand. The Gimbel et al. patent discloses that the puncture resistant stalls may be made from a wide variety of different materials including polymers, metal based materials including metal alloys, ceramics, elastomers, composites and their laminates, or composite combinations or blends. The Gimbel et al. Patent discloses that the stalls of the glove are applied to an outer surface of a glove's inner layer which contacts the skin of a health care provider's hand.

U.S. Pat. No. 4,911,433 which issued on Mar. 27, 1990, on an application filed in the names of John D. Walker and Larry Martin ("the Walker et al. Patent") discloses a baseball batting practice glove having a plurality of metallic weights releasably secured to the outer surface of the glove. The Walker et al. Patent discloses that the weights are effective during training to increase a hitter's hand strength and speed.

U.S. Pat. No. 4,947,487 which issued Aug. 14, 1990, on an application filed in the names of Jeffrey D. Saffer and Louis A. Profenno ("the Saffer et al. Patent") discloses a glove which prevents laser burn injuries to a wearer's hand. The glove disclosed in the Saffer et al. Patent is formed from a composite material containing optically reflective and dispersive particles. The optically reflective and dispersive particles included in the glove disclosed in the Saffer et al. Patent may be provided by metal filings such as aluminum filings; or mineral crystal grains such as quartz or salts, or ceramic materials. In one embodiment of the glove disclosed in the Saffer et al. Patent, a composite layer containing the optically reflective and dispersive particles is laminated between layers of flexible elastic material.

None of the disclosures summarized above reveals an application of pressure to the skin of a wearer's hand by a glove-like appliance to relieve symptoms of physical ailments.

SUMMARY OF THE INVENTION

The present invention provides a therapeutic appliance which envelopes at least a portion of human hand and contacts the skin of the hand for applying pressure thereto.

An object of the present invention is to provide a therapeutic appliance for relieving stress and its symptoms including headaches, tension in the back and shoulders, or wrist, back or shoulder pain.

Another object of the present invention is to increase an athlete's mobility by augmenting the flexibility of the muscles of the neck, shoulder and back.

Yet another object of the present invention is to increase blood circulation in the area of the wrist thereby strengthening the wrist.

Briefly the present invention is a therapeutic appliance having a supple, fitted covering that envelopes at least a portion of a human hand. The covering has an inner surface that is juxtaposed with and contacts the skin of the hand, and to which one or more pressure pads are secured. The appliance's covering urges each pressure pad into intimate contact with the skin of the hand for applying pressure thereto.

In a preferred embodiment, the present invention forms a glove which includes a plurality of separate sheaths for encircling each finger and the thumb of a hand. In this preferred embodiment, the covering encloses the entire hand including the back and a palm of the hand. A plurality of pressure pads are secured to the inner surface of the covering of this preferred embodiment for applying pressure to the skin of the hand at specific locations. Thus, pressure pads are secured on the inner surface of the covering enclosing the back of the hand, and are thereby urged into contact with an area on the skin of the back of the hand for relieving pain in the lower back. Another pressure pad is secured on the inner surface of that sheath which encircles a little finger of the hand to be urged into contact with the skin of the hand at an I38 meridian location on the skin of the little finger for relieving irritation, insomnia, anxiety, headaches, and neck and shoulder pain. Yet another pressure pad is secured on the inner surface of that sheath which encircles a ring finger of the hand to be urged into contact with the skin of the hand at a H2 meridian location for relieving stress, fatigue, anxiety, headache, and neck, shoulder and low back pain. Finally, pressure pads are secured on the inner surface of that sheath which encircles a middle finger of the hand to be urged into contact with the skin of the hand at a I9–I12 meridian for alleviating ailments of the heart, lung, and upper back pain.

In a preferred embodiment, each pressure pad is formed with one or more peaks that project a distance outward from the inner surface of the covering so the covering urges the peak of the pressure pad into contact with the skin of the hand. Each such peak is encircled by a ridge formed on the surface of each pressure pad so the ridge projects outward from the inner surface of the covering in the same direction as the peak for a distance which is less than the distance which the peak projects. The preferred embodiment of this pressure pad is formed from a metallic material, preferably aluminum.

These and other features, objects and advantages will be understood or apparent to those of ordinary skill in the art from the following detailed description of the preferred embodiment as illustrated in the various drawing figures.

DETAILED DESCRIPTION OF THE PREFERRED EMBODIMENT

Figure 1:
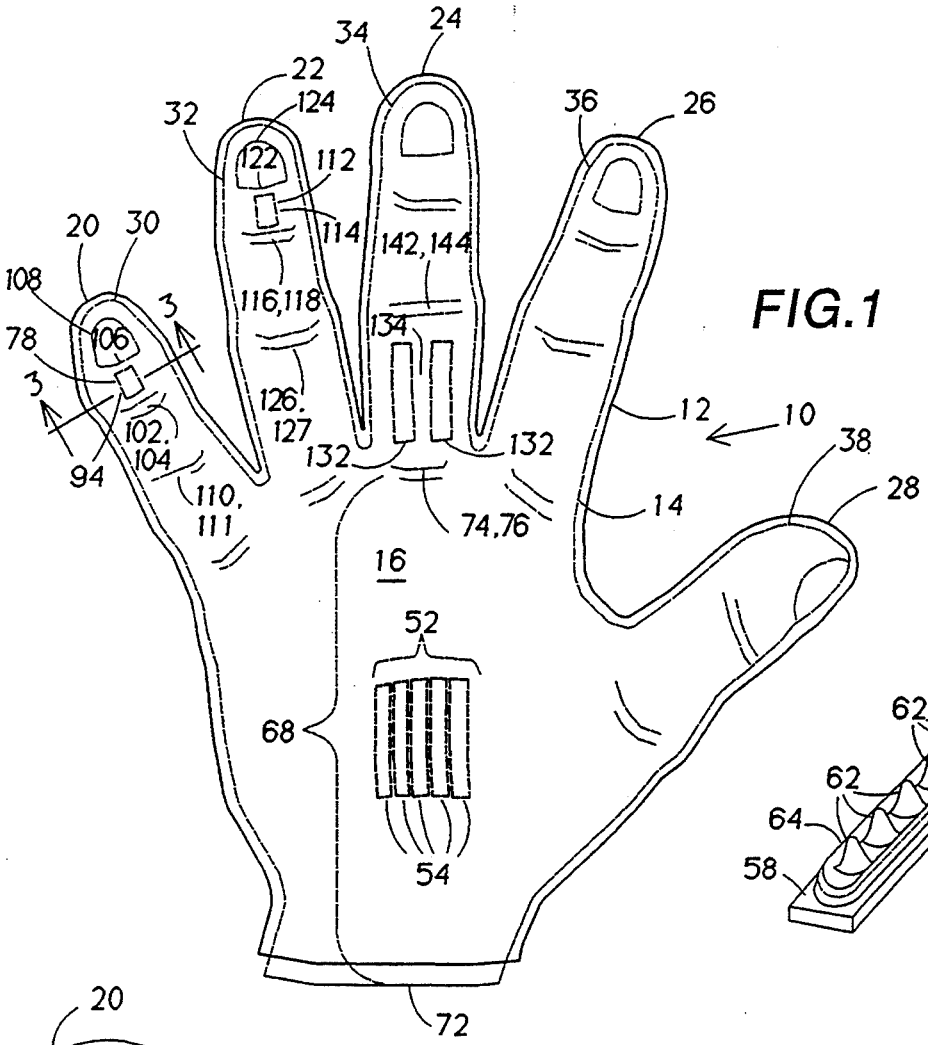
FIG. 1 is a plan view depicting a glove in accordance with the present invention enveloping a human hand illustrated by dashed lines, the glove includes a plurality of pressure pads, also illustrated by dashed lines, that are disposed at particular locations on the inner surface of the glove for applying pressure to the skin of the hand at specific locations.
Figure 3:
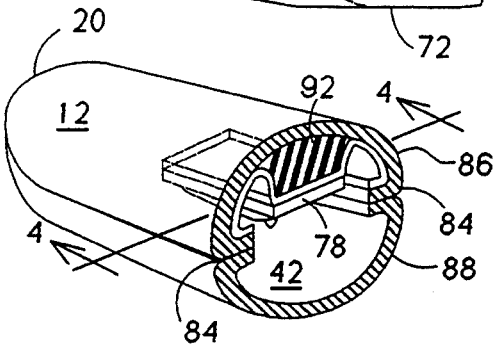
FIG. 3 is a cross-sectional view taken along the line 3—3 of FIG. 2 of that sheath of the glove depicted in FIG. 1 which encircles the little finger of the hand.

FIG. 1 depicts a glove in accordance with the present invention referred to by the general reference character 10. The glove 10 includes a covering 12 that is fabricated from a supple material such as woven cloth, leather, a natural or synthetic sheet material, etc. The covering 12 is tailored so the glove 10 envelopes a human hand 14, illustrated by dashed lines in FIG. 1, including a back 16 of the hand 14 and a palm of the hand 14, not illustrated in FIG. 1. The covering 12 of the glove 10 includes a plurality of separate sheaths 20, 22, 24, 26 and 28 which respectively encircle a little finger 30, a ring finger 32, a middle finger 34, an index finger 36, and a thumb 38 of the hand 14. An inner surface 42 of the covering 12, illustrated in FIG. 3, is juxtaposed with and contacts skin on the hand 14.

Figure 2:
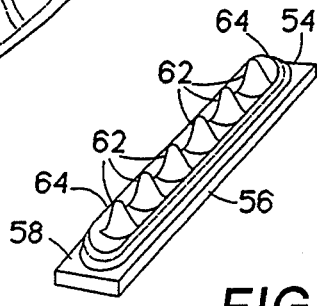
FIG. 2 depicts a pressure pad in accordance with the preferred embodiment of the present invention.

Secured on the inner surface 42 of the covering 12 which contacts the back 16 of the hand 14 is a first set 52 of five elongated pressure pads 54. As illustrated in FIG. 2, each of the pressure pads 54 is formed as an elongated bar 56 having a surface 58 above which projects a plurality of peaks 62. Also projecting above the surface 58 of the bar 56 is a ridge 64 which encircles the peaks 62. The pressure pad 54 is preferably 2.40 cm long by 0.50 cm wide, and is preferably made from aluminum. The peaks 62 project 0.15 cm above the surface 58 with the entire pressure pad 54 being 0.16 cm thick. The ridge 64 projects a lesser distance of 0.1 cm above the surface 58 of the bar 56 than the peaks 62.

The pressure pads 54 are secured on the inner surface 42 of the covering 12 to be urged into contact with an area on the back 16 of the hand 14 identified as a low back area 68. As depicted in FIG. 1, the low back area 68 extends from the middle of a wrist line 72 to a top 74 of a 1st knuckle 76 of the middle finger 34. It has been found that applying a moderate amount of pressure to the low back area 68 on the back 16 of the hand 14 is effective for relieving all kinds of pain in the lumbar and sacrum of the lower back. While a single, wider pressure pad might be substituted for the plurality of pressure pads 54, the several pressure pads 54 are to be preferred. By conforming more closely to any curvature of the back 16 of the hand 14 rather than concentrating all of the pressure over a small area, the several pressure pads 54 distribute pressure more uniformly over a larger area of the low back area 68 on the back 16 of the hand 14.

Figure 4:
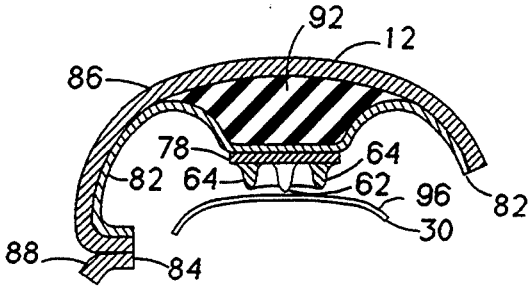
FIG. 4 is a cross-sectional view taken along the line 4—4 of FIG. 3 which illustrates attachment of the pressure pad to the inner surface of the glove.

Secured on the inner surface 42 of the covering 12 of the sheath 20 is a second pressure pad 78. The second pressure pad 78 is formed identically to one of the pressure pads 54 except that the length of the second pressure pad 78 is 0.80 cm rather than the 2.40 cm length of the pressure pad 54, and therefore the second pressure pad 78 includes only a single peak 62. As illustrated in FIGS. 3 and 4, enclosed within the covering 12 the second pressure pad 78 is secured to a layer 82 of fabric by contact cement, not illustrated in any of the FIGs. Within the sheath 20, the layer 82 of fabric extends from the second pressure pad 78 laterally toward both sides of the sheath 20 to a seam 84 where it is stitched together with an upper half 86 and a lower half 88 of the covering 12. Ends of the layer 82 extending along the sheath 20 parallel to the seam 84 beyond ends of the second pressure pad 78 are secured to the inner surface 42 of the covering 12 by contact cement, not illustrated in any of the FIGs.

Interposed between the inner surface 42 of the upper half 86 of the covering 12 and the layer 82 immediately adjacent to the second pressure pad 78 is a pyramidially-shaped block 92 of resilient material such as sponge rubber. The pyramidially-shaped block 92 of resilient material is 0.50 cm thick. A surface of the pyramidially-shaped block 92 contacting the layer 82 immediately adjacent to the second pressure pad 78 is the same size and shape as the second pressure pad 78, i.e., 0.50 cm wide by 0.80 cm long. A surface of the pyramidially-shaped block 92 which contacts the inner surface 42 of the covering 12 extends outward 0.50 cm along each side of the block 92 beyond edges of that surface of the block 92 contacting the layer 82.

The inner surface 42 of the covering 12 pressing against the block 92 of resilient material urges the peak 62 of the second pressure pad 78 into contact at an I38 meridian location 94 on skin 96 of the little finger 30. As depicted in FIG. 1, the I38 meridian location 94 is halfway between a center 102 of a third knuckle 104 and a bottom line 106 of a finger nail 108 of the little finger 30. It has been found that applying a moderate amount of pressure to the I38 meridian location 94 on the little finger 30 of the hand 14 relieves mental irritation, insomnia, anxiety, headaches, and pain of the neck and shoulder. The same effect may be achieved by locating the second pressure pad 78 halfway between the center 102 of the third knuckle 104 and a center 110 of a second knuckle 111 of the little finger 30.

Secured on the inner surface 42 of the covering 12 of the sheath 22 is a third pressure pad 112 which is formed identically to the second pressure pad 78. The inner surface 42 of the covering 12 of the sheath 22 urges the third pressure pad 112 into contact with the skin 96 of the hand 14 at a H2 meridian location 114 on the ring finger 32. The H2 meridian location 114 is halfway between a center 116 of a third knuckle 118 and a bottom line 122 of a finger nail 124 of the ring finger 32. It has been found that applying a moderate amount of pressure to the H2 meridian location 114 on the ring finger 32 relieves stress, fatigue, anxiety, headache, and pain of the neck, shoulder and low back. The same effect may be achieved by locating the third pressure pad 112 halfway between the center 116 of the third knuckle 118 and a center 126 of a second knuckle 127 of the ring finger 32.

Secured on the inner surface 42 of the covering 12 of the sheath 24 is a pair of fourth pressure pads 132. Each fourth pressure pad 132 is formed identically to one of the pressure pads 54 except that the length of the fourth pressure pad 132 is 1.50 cm rather than the 2.40 cm length of the pressure pad 54. Therefore, each fourth pressure pad 132 includes three peaks 62. The inner surface 42 of the covering 12 of the sheath 24 urges both fourth pressure pads 132 into contact with the skin 96 of the hand 14 at a I9–I12 meridian location 134 on the middle finger 34. The I9–I12 meridian location 134 is located between the top 74 of the 1st knuckle 76 and a center 142 of a second knuckle 144 of the middle finger 34. The fourth pressure pads 132 are positioned halfway between the top 74 of the 1st knuckle 76 and the center 142 of the second knuckle 144, and are respectively offset 0.1 inches on either side of a line joining the 1st knuckle 76 and the center 142 of the second knuckle 144. It has been found that applying a moderate amount of pressure to the I9–I12 meridian location 134 on the middle finger 34 alleviates ailments of the heart, lung, and pain of the upper back.

The structure described above for securing the second pressure pad 78 to the layer 82 with contact cement and interposing a block 92 of resilient material between the inner surface 42 of the covering 12 and the layer 82 immediately adjacent to the second pressure pad 78 is also employed for securing all of the first set 52 of pressure pads 54, third pressure pad 112, and fourth pressure pads 132 to the inner surface 42 of the covering 12. Similar to the second pressure pad 78, the layers 82, to which the third pressure pad 112 and the fourth pressure pads 132 are respectively secured by contact cement, are themselves secured on the inner surface 42 of the covering 12, respectively of the ring finger 32 and the middle finger 34, both by stitching to the seam 84 and by contact cement. However, no contact cement is used in securing the layer 82 of fabric to which the first set 52 of pressure pads 54 are secured by contact cement. Rather the layer of fabric to which the pressure pads 54 are secured is fastened to the inner surface 42 of the covering 12 by stitching which encircles the entire perimeter of the layer of resilient material interposed between the layer 82 and the inner surface 42 of the covering 12, and which passes through both the covering 12 and the layer 82.

Although the present invention has been described in terms of the presently preferred embodiment, it is to be understood that such disclosure is purely illustrative and is not to be interpreted as limiting. While the pressure pads 54, 78, 112, and 132 are preferably made from a metallic material such as aluminum, they may also be made from a magnetic material, from stainless steel, or from a quartz stone found in Korea and Japan. Since the application of pressure individually to the low back area 68, I38 meridian location 94, H2 meridian location 114, or I9–I12 meridian location 134 on the skin 96 of the hand 14 is effective for relieving the various symptoms described above, a therapeutic appliance in accordance with the present invention may be constructed which applies pressure at fewer than all of those locations. As is readily apparent, a therapeutic appliance which omits one or more of the pressure pads 54, 78, 112, and 132 as suggested in the preceding sentence does not require the use of a full glove, and therefore such an appliance could omit one or more of the sheaths 20, 22, 24, 26 and 28 of the glove 10. However, it has been found that the simultaneous application of pressure to the low back area 68, I38 meridian location 94, H2 meridian location 114, and I9–I12 meridian location 134 on the skin 96 of the hand 14 is more effective for relieving symptoms than an application of pressure at a lesser number of locations. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A therapeutic appliance adapted for enveloping at least a portion of a human hand and contacting skin of the hand, said therapeutic appliance comprising:

a supple, fitted covering tailored to form a sheath that encircles a middle finger of the hand, said covering having an inner surface that is juxtaposed with and contacts the skin of the hand; and a first pressure pad secured on the inner surface of the sheath to be urged into contact with the skin of the hand by said covering at a I9–I12 meridian location on the skin of the middle finger.

2. The therapeutic appliance of claim 1 wherein said covering encloses a back of the hand, said therapeutic appliance further comprising a second pressure pad secured on the inner surface of the covering enclosing the back of the hand, said covering urging said second pressure pad into contact with a lower back area on the skin of the back of the hand.

3. The therapeutic appliance of claim 1 wherein said covering includes a sheath that encircles a little finger of the hand, said therapeutic appliance further comprising a second pressure pad secured on the inner surface of the sheath that is urged into contact with the skin of the hand at an I38 meridian location on the skin of the little finger.

4. The therapeutic appliance of claim 1 wherein said covering includes a sheath that encircles a ring finger of the hand, said therapeutic appliance further comprising a second pressure pad secured on the inner surface of the sheath that is urged into contact with the skin of the hand at a H2 meridian location on the skin of the ring finger.

5. The therapeutic appliance of claim 1 wherein a surface of said first pressure pad is formed with a peak that projects a distance outward from the inner surface of said covering so said covering urges the peak of said first pressure pad into contact with the skin of the hand.

6. The therapeutic appliance of claim 5 wherein a ridge is also formed on the surface of said first pressure pad, the ridge encircling the peak and projecting outward from the inner surface of said covering in the same direction as the peak for a distance which is less than the distance which the peak projects.

7. The therapeutic appliance of claim 1 wherein said pressure pad is formed from a metallic material.

8. The therapeutic appliance of claim 7 wherein said pressure pad is formed from aluminum.

9. The therapeutic appliance of claim 1 further comprising a layer of resilient material disposed between the inner surface of said covering and said first pressure pad.

10. The therapeutic appliance of claim 1 wherein:

said covering forms a glove having a plurality of separate sheaths, said covering enclosing a back of the hand, a palm of the hand, one sheath respectively encircling each finger of the hand in addition to the sheath encircling the middle finger of the hand, and one sheath encircling a thumb of the hand;

said therapeutic appliance further comprising:

a second pressure pad which is secured on the inner surface of that sheath which encircles a little finger of the hand, said covering urging said second pressure pad into contact with the skin of the hand at an I38 meridian location on the skin of the little finger;

a third pressure pad secured on the inner surface of that sheath which encircles a ring finger of the hand, said covering urging said third pressure pad into contact with the skin of the hand at a H2 meridian location on the skin of the ring finger; and a fourth pressure pad secured on the inner surface of the covering enclosing the back of the hand, said covering urging said fourth pressure pad into contact with a lower back area on the skin of the back of the hand.

11. The therapeutic appliance of claim 10 wherein a surface of each pressure pad is formed with a peak that projects a distance outward from the inner surface of said covering so said covering urges the peak of said pressure pad into contact with the skin of the hand.

12. The therapeutic appliance of claim 11 wherein a ridge is also formed on the surface of each pressure pad, the ridge encircling the peak and projecting outward from the inner surface of said covering in the same direction as the peak for a distance which is less than the distance which the peak projects.

13. The therapeutic appliance of claim 11 wherein each pressure pad is formed from a metallic material.

14. The therapeutic appliance of claim 13 wherein each pressure pad is formed from aluminum.

15. The therapeutic appliance of claim 13 further comprising a plurality of individual layers of resilient material, one layer of resilient material being respectively disposed between the inner surface of said covering and each pressure pad.

16. The therapeutic appliance of claim 10 wherein said pressure pad is formed from a metallic material.

17. The therapeutic appliance of claim 16 wherein said pressure pad is formed from aluminum.

18. The therapeutic appliance of claim 10 further comprising a plurality of individual layers of resilient material, one layer of resilient material being respectively disposed between the inner surface of said covering and each pressure pad.

* * * * *